United States Patent [19]

Tiyony

[11] Patent Number: 4,884,810

[45] Date of Patent: Dec. 5, 1989

[54] CHANCE DEVICE WITH VARIABLY SIZED NUMBER SELECTING COMPARTMENTS

[76] Inventor: Joseph Tiyony, P.O. Box 34626, Phoenix, Ariz. 85067

[21] Appl. No.: 276,885

[22] Filed: Nov. 28, 1988

[51] Int. Cl.[4] ..... A63F 9/00

[52] U.S. Cl. ..... 273/144 B

[58] Field of Search ..... 273/144 R, 144 A, 144 B, 273/138 R

[56] References Cited

U.S. PATENT DOCUMENTS

| | | | |
|---|---|---|---|
| 1,613,575 | 1/1927 | Brewer | 273/144 B |
| 3,540,731 | 11/1970 | Muncey | 273/153 R X |
| 4,368,887 | 1/1983 | Gamble | 273/144 B |
| 4,403,775 | 9/1983 | Chaput | 273/144 B |
| 4,444,394 | 4/1984 | Pasqine | 263/144 B |
| 4,465,278 | 8/1984 | Messina | 273/144 B |
| 4,533,143 | 8/1985 | Albright | 273/145 C |
| 4,541,630 | 9/1985 | Dirks | 273/144 B |
| 4,545,578 | 10/1985 | Stagg, Jr. | 273/144 B |
| 4,807,881 | 2/1989 | Jaquez | 273/144 B |
| 4,807,882 | 2/1989 | Cimino | 273/144 B |

FOREIGN PATENT DOCUMENTS

| | | | |
|---|---|---|---|
| 2531344 | 2/1984 | France | 273/144 B |

*Primary Examiner*—Anton O. Oechsle

[57] ABSTRACT

A hand held game for randomly selecting numbers for a plurality of different types of games of chance, comprises a rectangular container including a bottom, end walls, side walls and transparent cover. The bottom is formed with a partition divides the game into upper and lower compartments, and is formed with a plurality of indentations in horizontal rows. Two side walls are formed with pairs of aligned openings for receiving a movably positioned partition, that while positioned, divides each time the lower compartment into two different portions. The number of rows of indentations in each portion selectively variable. The cover is formed with a plurality of highlighted numbers aligned with respective indentations. A plurality of balls of different colors within said compartments are receivable within any of the appropriate indentations, so that the respective aligned numbers on the cover are to be selected according to the appropriate type of game such as: Keno; Roulette; Pick 3; Horse racing and a plurality of types of the Lottery games.

9 Claims, 2 Drawing Sheets

FIG. 1
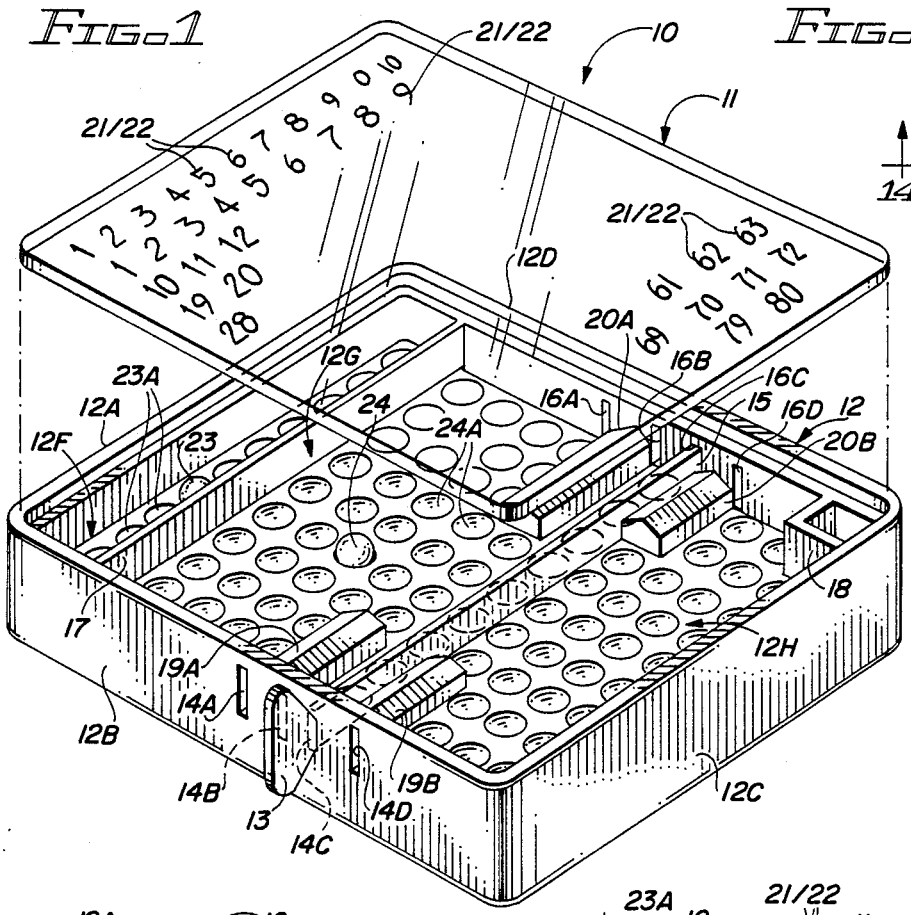
FIG. 13
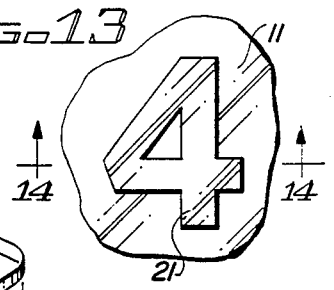
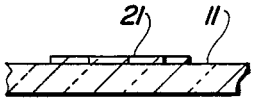
FIG. 14
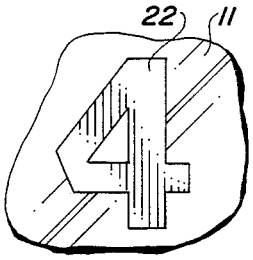
FIG. 15
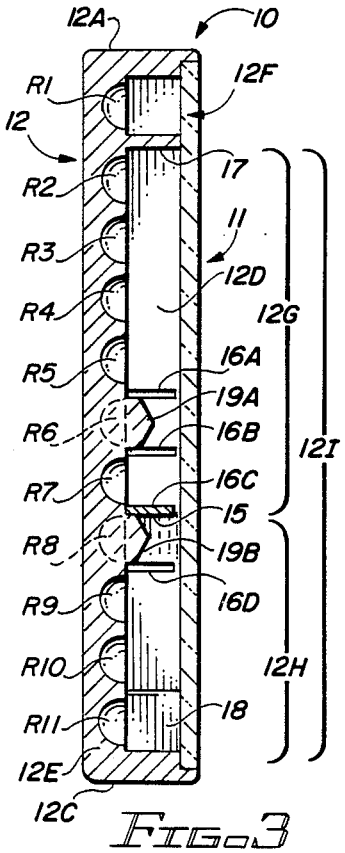
FIG. 3
FIG. 2
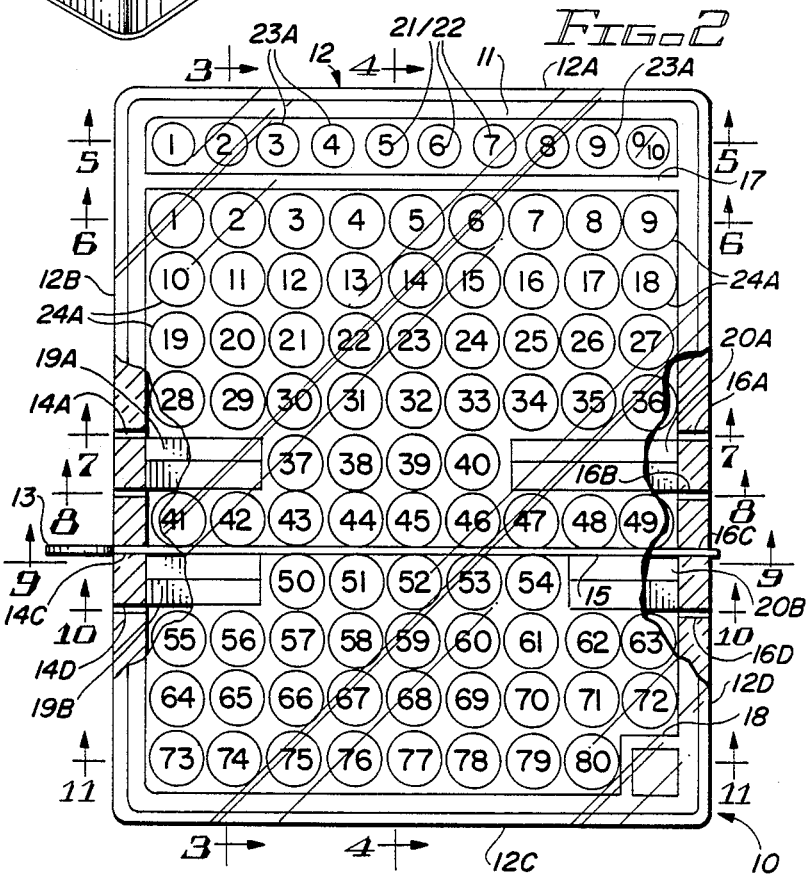

CHANCE DEVICE WITH VARIABLY SIZED NUMBER SELECTING COMPARTMENTS

BACKGROUND OF THE INVENTION

1. Technical Field

This invention provides a randomly selecting numbers device for a plurality of different types of games of chance and racing, including, but not limited, to 11 different games, which the selection of numbers for 2 types of games can be simultaneously made.

Randomly selecting numbers devices for games of chance have been known for years, mostly for selecting 6 numbers or less from sets of 10 numbers or larger sets, such as: 0 -9; 1-36; 1-40 and 1-49. For example, the players of the game Pick 3 select 3 numbers out of 10 consecutive numbers 0-9, and the players of the Lottery games in the States of Florida and California select exactly 6 numbers out of the range 1-49.

Thus, due to the growth of public interest in games of chance, states and countries play different types of games of chance with different ranges of numbers, in addition to the existing games such as the Keno and the Roulette.

2. Description of the Prior Art

The disadvantage of the existing devices for randomly selecting numbers is that each device can be use normally for one specific type of game with a specific range of numbers. Examples of this are disclosed in Chaput, U.S. Pat. No. 4,403,775; Gamble, U.S. Pat. No. 4,368,887; Messina, U.S. Pat. No. 4,465,278 and Dirks, U.S. Pat. No. 4,541,630.

The present invention presented herein provides a single changeable device, hand held and extremely light, for randomly selecting numbers for a plurality of different types of games of chance and racing with different types of ranges of numbers, including, but not limited, to the following: Keno; Roulette; Pick 3; Pick 4; Horse Racing; Dog Racing and several types of the Lottery game with the following ranges of numbers: 1-36; 1-40; 1-49; 1-54 and 1-80.

Accordingly, an object of this invention is to provide a hand held device for randomly selecting numbers for a plurality of different types of games of chance.

It is another object of this invention to provide a device that may be used for simultaneously selecting a plurality of sets of numbers from a plurality of larger sets of numbers.

It is still another object of this invention to provide a device that may be used for selecting a small set of elements from a larger sets of elements.

It is still another object of this invention to provide such a device that may be used to select a single element from a plurality of elements.

It is yet another object of this invention to provide a device that may be used to select a small set of numbers from a larger set of numbers.

It is another object of this invention to provide a small and easily hand held device, easily carried and extremely light weight.

It is another object of this invention to provide a device that is easy to operate and fast to select numbers within few seconds.

Further objects of this invention, along with the above described objects and advantages, will become more apparent by reading the following description and drawings.

SUMMARY OF THE INVENTION

Provided is a generally rectangular hand held container for randomly selecting numbers for a plurality of different types of games of chance and racing, such as: Keno; Roulette; Pick 4; Horse racing and different types of the Lottery game with different ranges of numbers, such as: 1-36; 1-40; 1-49; 1-54 and 1-80. The game may also be used to simultaneously select a plurality of sets of numbers from a plurality of larger sets of numbers.

According to the preferred embodiment, this container includes a substantially horizontal bottom, end walls, side walls and a transparent cover extending over and closing said container. The bottom is divided by a permanent partition into a small upper and a large lower compartments, and is formed with a plurality of horizontal rows of indentations. Both side walls are formed with at least a pair of aligned openings for receiving movably positioned partition which divides the lower compartment into at least 2 different portions each time being placed. The number of rows of indentations in each of portions is selectively variable based on the location of the partition.

The cover of the container is formed with a plurality of highlighted indicia such as Arabic numbers, being aligned each one with a respective one of said indentations. The container holds at least a ball within each compartment, and may include a plurality of balls of different colors within the lower compartment. All balls are freely movable and receivable within the appropriate indentations.

According to another variation of this invention, the indentations and/or the Arabic numbers can be formed in various orders; and the number of the partitions or balls can be different. In another variation, the game can be in any shape other than rectangular, and any partition can be either permanent o movably positioned.

By selecting the type of game, with or without placing the movable partition, and after shaking the game and placing it on a flat spot, each ball will be received by an appropriate indentation. The user then may select his numbers from the indicia with which the balls have aligned.

BRIEF DESCRIPTION OF THE DRAWINGS

FIG. 1 is an isometric illustration view of one embodiment of the device 10 showing the transparent cover and the bottom;

FIG. 2 is a top plan view of the embodiment of the invention, as seen in FIG. 1, portion thereof broken away;

FIG. 3 is a vertical section taken along line 3—3 in FIG. 2;

Figure 4:
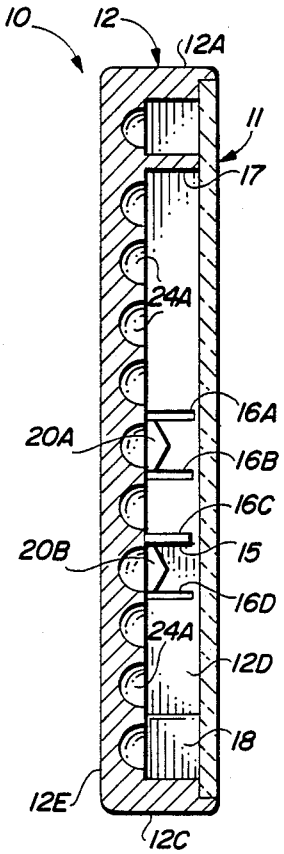
FIG. 4 is a vertical section taken along line 4—4 in FIG. 2.
Figure 12:
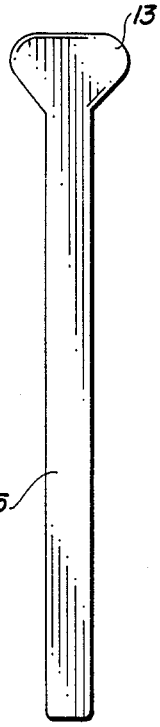
Figure 10:
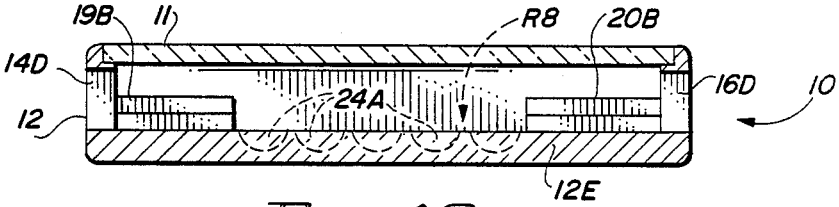
Figure 11:
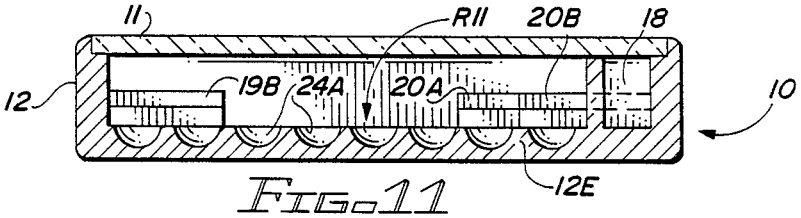

FIG .9 is a vertical section taken along line 9—9 in FIG. 2;

FIG. 10 is a vertical section taken along line 10—10 in FIG. 2;

FIG. 11 is a vertical section taken along line 11—11 in FIG. 2;

FIG. 12 is an elevational view of the divider and its handle,as one part, shown in FIG. 1;

FIG. 13 is an enlarged fragmentary portion of the cover seen in FIG. 1, and further detailing one of the character thereon;

FIG. 14 is a vertical section taken along line 14—14 in FIG. 13; and

FIG. 15 is a view generally corresponding to the view of FIG. 13 and showing an alternate embodiment thereof.

DETAILED DESCRIPTION OF THE INVENTION AND THE PREFERRED EMBODIMENT

By referring now more particularly to FIG. 1 of the drawings, it shows an isometric illustration view of the preferred embodiment of this invention, generally designated 10, comprising a rectangular container or housing 12; a transparent cover 11 extending over and closing said container; a substantially horizontal bottom, seen in FIG. 3, and endless sidewalls 12A, 12B, 12C and 12D upstanding from the bottom 12E. Said device 10 is preferably molded in one or more parts in an injection molding fabricated of a suitable transparent plastic material such as ACRYLIC; CRYSTAL STARING; FLEXIGLASS or the like.

The bottom 12E is formed with a plurality of horizontal rows of side by side indentations 23A and 24A; a partition 17 dividing said container into a small compartment 12F and a larger compartment 12 I, seen in FIG. 3, whereby the number of rows of indentations in each compartment is selectively variable.

In the preferred embodiment, as an example, compartment 12F containing one horizontal row of indentations 23A, all having equal diameter, and the lower compartment 12H containing of a plurality of horizontal and vertical rows of indentations 24A, preferably ten in this example. Said indentations 24A all having equal diameter, which is slightly larger than the diameter of the indentations 23A.

The transparent cover 11 of the device 10 is formed with a plurality of indicium 21/22, preferably Arabic numbers, but other indicium may be used such as: Roman numeral; Alphabet; Alpha-numeric and such combinations and symbols. Said Arabic numbers, indicium 21/22 in FIG. 1, are formed in a plurality of horizontal rows, preferably eleven, but may be more or less; said indicium may be molded, or silk screened. Each of said numbers is being aligned with a respective indentation 23A or 24A, however, two numbers, such as "o" and "10", in smaller size than the other, having slash sign between them, i.e.0/10, may be aligned with one respective indentation, as seen in FIGS. 1 and 2.

The container 12 further includes at least a pair of vertical aligned openings formed in said walls 12B and 12D. The example of the preferred embodiment in FIG. 1 shows four pairs of aligned openings 14A-16A; 14B-16B; 14C-16C and 14D-16D, all having equal height, which is slightly smaller than the distance from the bottom to the top of the device.

By referring now to the partition 17, while it is preferably fixed, another partition, designated divider 15, movably positioned with its handle 13 as one part, as seen in FIGS. 1 and 12. Both, partition 17 and divider 15 may be fixed or movable, and there may be more partitions or dividers. Said divider 15 has the appropriate width, height and thickness to allow easy placement through any pair of aligned openings exactly below an appropriate row of indentations, leaving no space between the divider and the row above it. Also, each time being positioned so, divider 15 divides the compartment 12 I, seen in FIG. 3, into two portions each one having a plurality of rows of indentations.

The example in FIG. 1 shows portion 12G containing of six rows and portion 12H containing of four rows.

Container 12 also including a plurality of balls 23 and 24, preferably made of plastic material, but may be steel, for free movement within the appropriate compartment. In this example of the preferred embodiment, compartment 12F includes a ball 23, having a diameter which is slightly smaller than the diameter of indentations 23A. A ball 23 is shown in FIG. 1 having recess in an indentation 23A. The compartment 12 I includes six balls 24 which may all have any color, but preferably differently colored.

Said balls 24 are all in equal diameter, which is slightly larger than the diameter of ball 23, and slightly smaller than the diameter of the indentations 24A. A ball 24 is shown in FIG.1 having recess in an indentation 24A. Thus, compartment 12F may also include a plurality of balls 23, and compartment 12 I may also include a single ball 24 or a plurality of balls 24.

Still referring to FIG. 1, it shows the bottom 12E, seen in FIG. 3, formed with sloping projections, each part of each projection slopes toward the bottom 12E, but stops far enough to allow the balls 24A to pass over for free movement. In this example, the bottom 12E is formed with four projections 19A; 19B; 20A and 20B. Projection 20A covers an area equal to an area of three indentations 24A, and the other projections cover each one an area equal to an area of two indentations 24A.

The purpose of said projections is to prevent any of the balls having recess in the occupied area by either one of the projections. It is also shown an enclosure 18 blocks off a portion of the container from the bottom to the top, occupying an area equal to an area of one indentation 24A. There may be more such enclosures or projections, in any size, according to the structure of the indentations and the indicia.

By referring now particularly to FIG.2, it shows a top plan view of the preferred embodiment of this invention, as seen in FIG. 1, portion thereof broken away. The first upper row of said Arabic numbers, seen along line 5—5 in FIG. 2, consists of a set of consequent numbers from 0 to 10, which may be placed in any order.

It also shows the other numbers being formed in rows below the above first row, in one type of form, consists of 80 consecutive numbers from 1 to 80, in between the lines 6—6 to 11—11 in FIG. 2. Said indicium 21/22 may also be placed in many different forms other than is presented here, in regard to the structure of the rows of indentations, the types of games, etc, since the idea is that the device provided herein may be used for at least eleven different types of games of chance—all in one single game.

Examples for possible changes: The set of numbers 1 to 9, seen along line 6—6 in FIG. 2, may be interchanged with the indicium seen along the line below; The indicium 1 to 80 may be placed in consequent order instead of consecutive, and, similarly, projection 19A may be interchanged with the two indentations 24A below etc.

Figure 5:
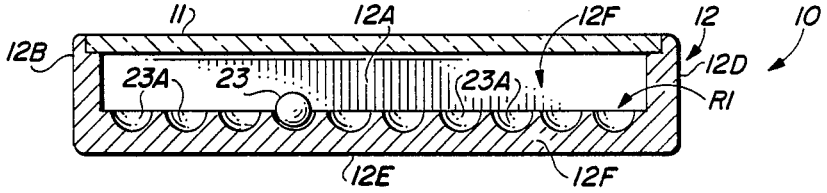
FIG. 5 is a vertical section taken along line 5—5 in FIG. 2.
Figure 6:
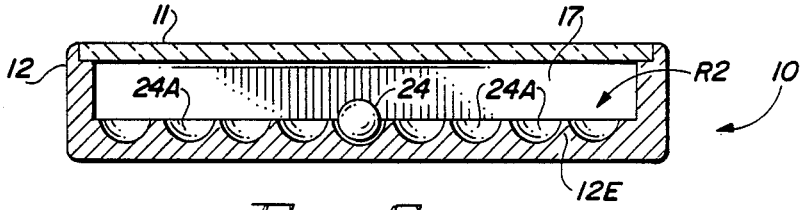
FIG. 6 is a vertical section taken along line 6—6 in FIG. 2.
Figure 7:
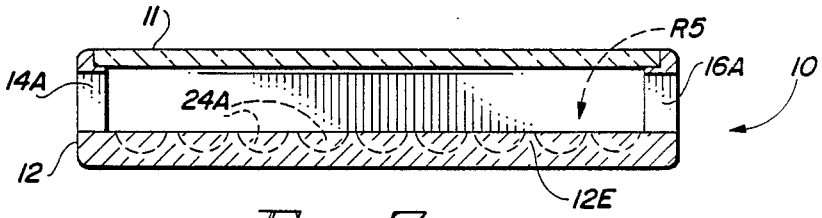
FIG. 7 is a vertical section taken along line 7—7 in FIG. 2.
Figure 8:
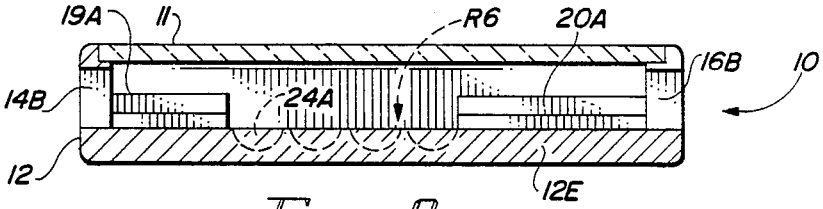
FIG. 8 is a vertical section taken along line 8—8 in FIG. 2.

In supporting of FIGS. 1 and 2, the FIGS. 3 through 11 show longitudinal sections taken along the lines 3—3 to 11–11 in FIG. 2 for perceptivity of the structure of the preferred embodiment of this invention. Examples: FIG. 5 is a section taken along line 5—5 in FIG. 2, showing the cover 11; the side walls 12A, 12B, 12C and 12D; the bottom 12E formed with ten indentations 23A, and a ball 23 having recess in an indentation 23A in compartment 12F.

Figure 9:
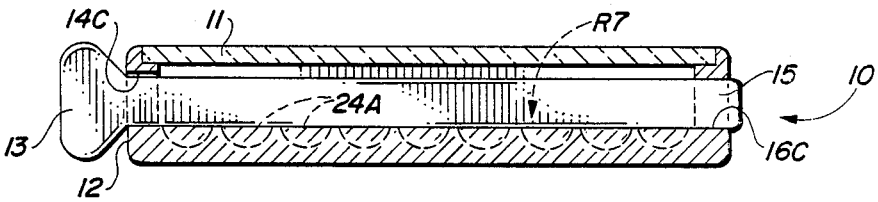

FIG. 9 shows a section taken along line 9—9 in FIG. 2, showing a divider 15 being placed through a pair of aligned openings 14C–16C; the cover 11; nine indentations 24A, while R7 presents the seventh row of indentations.

By referring now to FIG. 12, it shows an elevational view of the divider 15, which preferably is made of plastic, but may be made of other flexible material.

Since the indicium designated as 21/22 for Arabic numbers, as an example, FIG. 13 shows an enlarged fragmentary portion of the cover 11 seen in FIG. 1, showing a typical molded number. FIG. 14 shows a section taken along line 14—14 in FIG. 13. Similarly, FIG. 15 is a view generally corresponding to the view of FIG. 13, showing an alternate embodiment thereof, representing a typical indicium 22 silk screened on the cover 11.

IN OPERATION of the preferred embodiment, as an example, the user holds the device 10, shakes it and places it on a flat spot so that each balls 23 and 24 is received by one of the appropriate indentations 23A and 24A. The user then may select his numbers for one or two games simultaneously from the indicia formed on the cover 11, with which the balls have aligned.

Since the device provided herein is for at least eleven different types of games and racing, the specific selection by the type of games and racing is as follows:

(1) For the KENO game and for the LOTTERY game with the range of 80 numbers: after shaking and placing the device, the user may select any of the numbers aligned with the respective balls 24 received by the appropriate indentations 24A.

(2) For the games and racing PICK 3; PICK 4; HORSE RACING AND DOG RACING: the user may select the number aligned with a respective ball 23 received by the appropriate indentation 23A.

To select more numbers, the user may repeat the selection action as described above. Should the upper compartment 12F include more than one ball 23, the user then repeats the selection action accordingly.

(3) For the ROULETTE game and for the following different types of the LOTTERY games with the ranges of numbers: 1–36; 1–40; 1–49 and 1–54 the user moves the balls 24 up the the partition 17, then he places the divider 15 through the appropriate pair of aligned openings, according to the range of numbers formed above the specific pair of openings and the type of game. The user than repeats the selection action, i.e. shaking and placing the device, and selects any of the numbers aligned with the balls received by the respective indentations 24A.

The preferred embodiment of this invention has been illustrated and described by way of example only, which is not limited to the details shown and described herein. Therefore, it should be understood that various changes and modifications of this invention can be made within the principles; spirit; advantages; usefulness and the scope of this invention, as partly illustrated, detailed and described in the drawings and the description herein, and which is also set forth in the appended claims.

What is claimed is:

1. A hand held game device for randomly selecting numbers for a plurality of different types of games of chance, said game comprising:

(a) a generally rectangular container containing a substantially horizontal bottom, and an endless sidewall upstanding from said bototm;

(b) a plurailty of indentations formed into said bottom, said indentations being formed into a plurality of spaced apart rows;

(c) a transparent cover extending over and closing said container;

(d) a plurality of indicia carried bys aid cover, each of said indicia being aligned with a respective one of said plurality of indentations;

(e) at least one ball freely movable within said container and receivable within said each of said plurality of indentations; and (f) a partition for dividing said container into a first compartment containing at least one of said rows, and a second compartment containing the other of said rows, said partition being movably positionable whereby the number of rows in each of said compartments is selectively variable.

2. The device of claim 1, further including a pair of aligned openings in said sidewall for receiving said partition therethrough.

3. The device of claim 1, wherein said first compartment includes 10 indentations in one horizontal row, and said second compartment includes 80 indentations in 10 horizontal rows and 9 vertical columns.

4. The device of claim 3, wherein said indentations formed into said first compartment have the same diameter.

5. The device of claim 3, wherein said indentations formed into said second compartment have the same diameter.

6. The device of claim 5, wherein the diameter of the indentations in the second compartment is slightly larger than the diameter of the indentations of said first compartment.

7. A hand held game device for randomly selecting numbers for a plurality of different types of games of chance, said game comprising:

(a) a generally rectangular container including a substantially horizontal bottom, and an endless sidewall upstanding from said bottom;

(b) a plurality of indentations formed into said bottom, said indentations being formed into a plurality of spaced apart rows;

(c) a transparent cover extending over and closing said container;

(d) a plurality of indicia carried by said cover, each of said plurality of indicia being aligned with a respective one of said plurality of indentations;

(e) at least one ball freely movable within said container and receivable within each of said plurality of indentations;

(f) a first partition for dividing said container into a first compartment containing at least one of said rows and a second compartment containing the other of said rows; and (g) a second partition for dividing said second compartment of said container into a first portion and a second portion, said second partition being movably positionable whereby the number of rows in each of said portions is selectively variable.

8. The device of claim 7, further including at least one pair of aligned openings formed in the sidewall of said second compartment for receiving asid second partition therethrough.

9. The device of claim 7, further comprising a plurality of pairs of aligned openings formed in the sideall of said second compartment, wherein said movable partition can be placed through any of said pairs of openings to separate said first and second portions.

* * * * *

UNITED STATES PATENT AND TRADEMARK OFFICE

CERTIFICATE OF CORRECTION

PATENT NO. : 4,884,810

DATED : December 5, 1989

INVENTOR(S) : Joseph Tziony

It is certified that error appears in the above-identified patent and that said Letters Patent is hereby corrected as shown below:

On the title page inventor should read

--(76) Inventor: Joseph Tziony--.

Inventor's address should read

-- P.O. Box 12
Scottsdale, AZ 85252--,

Signed and Sealed this

Tenth Day of April, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,884,810
DATED : December 5, 1989
INVENTOR(S) : Joseph Tziony

It is certified that error appears in the above-identified patent and that said Letters Patent is hereby corrected as shown below:

Title page,
Inventor: should read

-- [76] Inventor: Joseph Tsiyoni --.

Inventors's address should read

-- P.O. Box 12
Scottsdale, AZ 85252

This certificate supercedes certificate of correction issued April 10, 1990.

Signed and Sealed this

Eleventh Day of December, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 4,884,810
DATED : December 5, 1989
INVENTOR(S) : Joseph Tsiyoni

It is certified that error appears in the above-identified patent and that said Letters Patent is hereby corrected as shown below:

Title page,
Inventor: should read

-- [76] Inventor: Joseph Tsiyoni --.

Inventors's address should read
-- 1404 North Rose Street
Tempe, AZ 85281

This certificate supercedes certificate of correction issued December 11, 2001.

Signed and Sealed this

Eighth Day of January, 2002

*Attest:*

*Attesting Officer*

JAMES E. ROGAN
*Director of the United States Patent and Trademark Office*